United States Patent [19]

Caravatti

[11] Patent Number: 4,924,089

[45] Date of Patent: May 8, 1990

[54] METHOD AND APPARATUS FOR THE ACCUMULATION OF IONS IN A TRAP OF AN ION CYCLOTRON RESONANCE SPECTROMETER, BY TRANSFERRING THE KINETIC ENERGY OF THE MOTION PARALLEL TO THE MAGNETIC FIELD INTO DIRECTIONS PERPENDICULAR TO THE MAGNETIC FIELD

[75] Inventor: Pablo Caravatti, Winterthur, Switzerland

[73] Assignee: Spectrospin AG, Switzerland

[21] Appl. No.: 251,192

[22] Filed: Sep. 29, 1988

[30] Foreign Application Priority Data

Oct. 7, 1987 [DE] Fed. Rep. of Germany ..... 3733853

[51] Int. Cl.[5] ..... H01J 49/36

[52] U.S. Cl. ..... 250/290; 250/291

[58] Field of Search ..... 250/290, 291, 293, 281, 250/282, 288

[56] References Cited

U.S. PATENT DOCUMENTS

| | | | |
|---|---|---|---|
| 3,502,867 | 3/1970 | Beauchamp | 250/290 |
| 3,922,543 | 11/1975 | Beauchamp | 250/290 |
| 3,984,681 | 10/1976 | Fletcher et al. | 250/290 |
| 4,563,579 | 1/1986 | Kellerhals et al. | 250/291 |
| 4,581,533 | 4/1986 | Littlejohn et al. | 250/282 |
| 4,686,365 | 8/1987 | Meek et al. | 250/281 |
| 4,739,165 | 4/1988 | Ghaderi et al. | 250/290 |
| 4,746,802 | 5/1988 | Kellerhals | 250/291 |
| 4,761,545 | 8/1988 | Marshall et al. | 250/291 |
| 4,818,864 | 4/1989 | Alleman | 250/291 |

OTHER PUBLICATIONS

Baykut et al, "Fourier Transform Ion Cyclotron Resonance Mass Spectrometry", Trends in Analytical Chemistry, vol. 5, No. 2, 1986, pp. 44–49.

*Primary Examiner*—Bruce C. Anderson

*Attorney, Agent, or Firm*—Harness, Dickey & Pierce

[57] ABSTRACT

Method and apparatus for introducing ions into an ion trap of an ion cyclotron resonance spectrometer, the ion trap being arranged in a constant homogeneous magnetic field and comprising walls which are designed as electrodes and extend in parallel and/or perpendicularly to a symmetry axis having the direction of the magnetic field and which are supplied with electric trapping potentials retaining the ions in the ion trap, one of the walls which extend perpendicularly to the magnetic field being provided with a hole, the method including the steps of generating the ions outside the ion trap, forming the ions into an ion beam, directing the ion beam upon the hole in the one wall of the ion trap, in the direction of the magnetic field, and reducing thereafter the velocity component, in the direction of the magnetic field, of the ions which have passed the hole and entered the ion trap, below the value determined by the trapping potentials which is needed by the ions for leaving the ion trap, characterized in that the ions that have entered the ion trap are imparted a second motion component in a direction perpendicular to the magnetic field, such that the magnitude of the vector sum of the two ion velocity components remains the same.

11 Claims, 1 Drawing Sheet

METHOD AND APPARATUS FOR THE ACCUMULATION OF IONS IN A TRAP OF AN ION CYCLOTRON RESONANCE SPECTROMETER, BY TRANSFERRING THE KINETIC ENERGY OF THE MOTION PARALLEL TO THE MAGNETIC FIELD INTO DIRECTIONS PERPENDICULAR TO THE MAGNETIC FIELD

The present invention relates to a method for introducing ions into the ion trap of an ion cyclotron resonance spectrometer, the ion trap being arranged in a constant homogenous magnetic field and comprising walls which are designed as electrodes and extend in parallel and/or perpendicularly to the direction of the magnetic field and which are supplied with electric trapping potentials retaining the ions in the ion trap, one of the walls which extends perpendicularly to the magnetic field being provided with a hole, the method including the steps of generating the ions outside the ion trap, forming the ions into an ion beam, directing the ion beam upon the hole in the one wall of the ion trap, in the direction of the magnetic field, and reducing thereafter the velocity at which the ions which have passed the hole and entered the ion trap move in the direction of the magnetic field, below the value determined by the trapping potentials which is needed by the ions for leaving the ion trap.

A method of this kind has been known before from DE-OS 35 15 766. The known method has two variants. One of these variants consists in increasing temporarily the gas pressure in the ion trap for reducing the velocity of the ions that have entered the ion trap, in order to slow down the ions. This variant requires that gas has to be pumped off after the ions have been shot in, which not only extends the process time but may lead also to ion losses and fragmentation of the ions.

According to other variants, the velocity of the ions is reduced by a decelerating electrode arranged upstream of the ion trap, and at the same time the trapping potentials are switched off to enable the ions to enter the ion trap in spite of their reduced velocity. Thereafter, the trapping potentials are switched on again so as to trap the ions present in the ion trap. However, this variant is also not capable of achieving in the ion trap the ion concentration maximally possible and desirable to obtain the best possible sensitivity for recording the ion cyclotron resonance spectrum.

Now, it is the object of the present invention to provide a method for slowing down the speed, in the direction of the magnetic field, of those ions which have entered the ion trap, which method be carried out easily and results in increased density of the trapped ions.

This object is achieved according to the invention by the fact that the ions that have entered the ion trap are imparted a motion component in a direction perpendicular to the magnetic field.

Consequently, the velocity of the ions in the direction of the magnetic field, which enables the ions to leave the ion trap, is slowed down in the case of the method according to the invention not by increasing the gas pressure, or by providing a decelerating electrode, but rather by causing the ions to drift off their original path of movement in the direction of the magnetic field so that once the ions have entered the ion trap they will move along a path which results in an extension of their average dwelling time in the ion trap. This increases considerably the period of time during which the ions are permitted to accumulate, and the ion flow can be maintained until the maximum ion density, which is limited by the average dwelling time, has been reached in the ion trap. It is a particular advantage in this connection that no critical operating parameters have to be adhered to, as regards the value or the duration of the potentials to be applied.

According to a particularly simple embodiment of the method according to the invention, the ions are introduced into the ion trap along an axis set off laterally from the axis of symmetry of the ion trap extending in parallel to the magnetic field. This can be achieved simply by arranging the ion beam and the ion trap with a certain lateral offset relative to each other. Due to this lateral offset, the ions entering the ion trap get into an area where the electric field prevailing due to the potentials applied to the walls of the ion trap exhibits a transversal component which leads to a certain lateral deflection of the ions. The ions are thereby forced to perform a cyclotron movement along paths which result in the desired extension of the dwelling time of the ions in the ion trap.

According to another variant of the method according to the invention, an electric field directed transversely to the direction of the magnetic field is generated during the time of application of the ion beam, and preferably in the direct neighborhood of that wall of the ion trap which is provided with the hole. Such a field may be generated in a simple manner by means of additional electrodes arranged in the ion trap. Neither the value nor the duration of application of the field are critical. However, the field has to be switched off before the spectra-recording process proper is commenced.

It may be convenient for both variants of the method to reduce the potential of that wall of the ion trap, which is provided with the hole, below the trapping potential during application of the ion beam, so that the ions can be shot into the ion trap at reduced axial velocity, which has a favorable influence on the trapping process.

The present invention further relates to an ion cyclotron resonance spectrometer adapted for carrying out the method according to the invention. It comprises in the conventional manner an ion trap which is arranged in a constant homogeneous magnetic field and comprises walls which are designed as electrodes and extend in parallel or perpendicularly to the direction of the magnetic field and which are supplied with electric trapping potentials retaining the ions in the ion trap, one of the walls extending perpendicularly to the magnetic field being provided with a hole. The spectrometer further comprises means for introducing ions into the ion trap comprising an ion source, means for generating an ion beam which is emitted by the ion source in the direction of the magnetic field and directed upon the hole in the one wall of the ion trap, and means for reducing the velocity at which the ions which have passed the hole and entered the ion trap move in the direction of the magnetic field, below the value determined by the trapping potentials which is needed by the ions for leaving the ion trap.

According to the invention, the means for reducing the velocity of the ions in the direction of the magnetic field are adapted for imparting to the ions that have entered the ion trap a motion component perpendicular to the direction of the magnetic field.

According to one embodiment of the spectrometer according to the invention, the hole arranged in one wall of the ion trap is laterally offset relative to that axis of symmetry of the ion trap which extends parallel to the magnetic field.

According to another embodiment of such a spectrometer, electrodes which are insulated from the wall and which are connected to a voltage source that can be switched on in pulse-like manner are arranged on both sides of the hole provided in the one wall of the ion trap. It will be appreciated that such electrodes can be used also when the hole provided in the one wall of the ion trap is set off from the center of the wall.

Further, the potential of the wall opposite the wall provided with the hole may differ from the potential of the wall provided with the hole, with respect to the ionic charge.

It will be appreciated that the method according to the invention does not require any complicated measures regarding the design of the spectrometer, but can be effected with relatively small modifications which do not oppose the application of the method according to the invention.

The invention will now be described and explained in more detail with reference to the embodiments illustrated in the drawing. The features that can be derived from the description and the drawing may be used in other embodiments of the invention either individually or in any desired combination. In the drawing.

Figure 1:
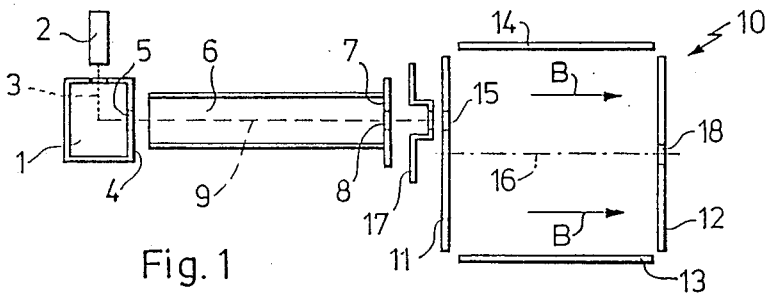
FIG. 1 shows a diagrammatic representation of a first embodiment of an ion cyclotron resonance spectrometer according to the invention.

The ion cyclotron resonance spectrometer illustrated diagrammatically in FIG. 1 comprises an ion source 1 in the form of a cell coacting with an electron gun 2 by which an electron beam 3 indicated by a broken line can be shot into the chamber 1 for ionizing the gas contained in the said cell. A wall 4 of the ion source 1 is provided with a small hole 5 through which the ions can leave the ion source 1. The ion source 1 is followed by a flight channel 6 which extends coaxially to the hole 5 in the wall 4 of the ion source 1 and which, when the system is operated with positive ions, is maintained in operation at a relatively high potential of −1 kV to −3 kV. The end of the flight channel 6 opposite the ion source 1 is equipped with a mask 7 provided with a hole 8 through which the ion beam 9 formed by means of the flight channel 6 and indicated in the figure by a broken line is permitted to escape from the flight channel 6. The flight channel 6 is followed by an ion trap 10 comprising two walls 11, 12 extending perpendicularly to the direction of the ion beam 9, and four walls extending in parallel to this direction. Of the last-mentioned four walls, only the two walls 13, 14 extending perpendicularly to the drawing plane can be seen, while the other two walls extend in parallel to the drawing plane. The wall 11 of the ion trap neighboring the flight channel 6 is provided with a hole 15 upon which the ion beam 9 is directed. The ion beam 9 extends in parallel to the axis 16 of the ion trap, but is laterally offset relative to this axis. Between the end of the flight channel 6 and the ion trap 10 a decelerating electrode 17 is arranged for slowing down the ions to a suitable potential before they enter the ion trap. Typical operating potentials for the walls of the ion trap are 0 V for the wall 11 neighboring the flight channel 6, +0.5 V for the wall 12 extending in parallel thereto, 1 V for the walls which extend in parallel to the ion beam and of which only the walls 13, 14 are shown, and −0.5 V for the decelerating electrode. It is noted here once more that all these values apply to the examination of positive ions. If negative ions are to be examined, potentials with inverse signs are employed. In operation, the ion trap is located in a constant homogeneous magnetic field B extending in parallel to the direction of the ion beam 9 and to the axis 16 of the ion beam 10. The magnetic field is indicated in the drawing by arrows.

Although in operation of the ion cyclotron resonance spectrometer illustrated in FIG. 1 the impulse of the ions introduced into the ion trap 10 in the form of the ion beam 9 is largely reduced, it must still be sufficiently great to enable the ions to overcome the potential of the wall 11 of the ion trap adjacent the flight channel 6. This impulse is generally sufficient also to enable the ions to reach the other wall 12 extending perpendicularly to the direction of the ion beam and to the magnetic field B, and to get lost—either by impinging upon this wall or by escaping from the ion trap through a hole 18 arranged in the wall 12 concentrically to the axis 16 of the ion trap 10—in case the ion beam would enter the ion trap along the axis 16. However, in the case of the embodiment illustrated in FIG. 1, the ion beam 9 is offset relative to the axis 16 of the ion trap 10 so that it enters an area of the ion trap 10 where the electrostatic field existing inside the ion trap 10 and obtained inside the ion trap as a result of the potentials applied to the walls, comprises certain component directed transversely to the axis 18 with the result that when the ions enter the ion trap 10 they are deflected from their straight path, due to the prevailing magnetic field and the electrostatic field, whereby their impulse component in the direction of the cell axis 16 is reduced below the value needed to cause the ions to leave the cell immediately. It is ensured in this manner that the dwelling time of the ions that have entered the ion trap 10 is increased quite considerably and that, accordingly, a very high ion density can be obtained by accumulation of the ions during their dwelling time. The duration of the ion beam required for achieving a high ion density in the ion trap corresponds to the maximally achievable dwelling time of the ions; it is in the range of between 10 and 500 ms and determined, amount other things, by the intensity of the ion flow.

Figure 2:
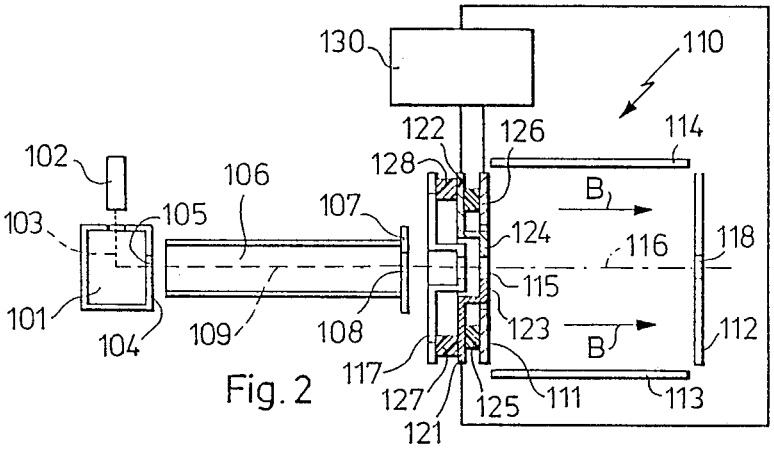
FIG. 2 shows a diagrammatic representation of a second embodiment of an ion cyclotron resonance spectrometer according to the invention.

The embodiment of an ion cyclotron resonance spectrometer illustrated in FIG. 2 comprises again an ion source 101 in the form of a cell filled with gas into which an ionizing beam 103 an be shot by means of an electron gun 102 or a laser. The ions leaving the ion source 101 are again formed into an ion beam 109, by means of a flight channel 106, and the ion beam 109 is permitted to leave the flight channel through the hole 108 in a mask 107 provided at the end of the flight channel opposite the ion source 101. The ion beam 109 is directed upon an ion trap 110 which, just as in the case of the embodiment of FIG. 1, comprises walls 111 and 112 extending perpendicularly to the ion beam 109 and walls 113 and 114 extending in parallel to the beam. The wall 111 facing the flight channel 106 is again provided with an opening 115, but here the opening 115 is arranged concentrically to the axis 116 of the ion trap.

The wall 111 of the ion trap adjacent the flight channel 106 carries on its outside two electrodes 121, 122 arranged diametrically opposite each other and comprising bent-off portions 123, 124 which project into the hole 115 where they form extensions of the wall 111. The electrodes 121, 122 are fixed to the wall 111 by means of insulating pieces 125, 126 not shown in detail and serve simultaneously as supports for the decelerating electrode 117 which is similarly fixed to the electrodes by means of insulating pieces 127, 128. It will be appreciated that the insulating pieces 125, 126 and 127, 128 may be part of plate-shaped, in particular annular insulating and supporting bodies, or may be constituted simply by insulating rings surrounding screws which have been screwed into the wall 111 for fixing the electrodes in place. The illustrated arrangement provides the particular additional advantage that the electrodes can be mounted in such a manner that they can be displaced relative to the wall 111 for adjusting purposes.

In operation, the potentials applied to the flight channel 106, the decelerating electrode 117 and the plates 111, 112, 113, 114 of the ion trap are substantially the same as stated above for the embodiment shown in FIG. 1. In addition, however, a voltage in the range of 2 to 10 V is applied to the electrodes 121, 122, for the duration of the ion beam, by means of a voltage source 130 which can be switched on in pulse-like manner. This voltage is, preferably, symmetrical to the potential applied to the wall 111 carrying the electrodes 121, 122, although this is not absolutely necessary. Quite to the contrary, a certain dissymmetry of the voltages may even be of advantage, especially depending on the location of the passage opening for the ion beam between the electrodes.

In operation, the ion trap 110 is again located in a constant homogeneous magnetic field B extending in parallel to the axis of the ion trap 116, as indicated in the drawing by corresponding arrows. A constant potential of −1 V is applied to the walls 113, 114 extending in parallel to th axis 116 of the cell, while a constant potential of 0 V is applied to the wall 111 extending perpendicularly to the magnetic field, as illustrated by line (a) in FIG. 3. Prior to commencing an experiment, a so-called quench pulse is usually applied to the wall 112 opposite the flight channel 106 which extends perpendicularly to the magnetic field. The quench pulse may, for example, have a potential of −9 V and serve for expelling any ions which may be present in the ion trap 110 and which then either leave the ion trap through the central hole 118 in the wall 112, or impinge upon the walls of the cell whereby they are neutralized. The quench pulse 131 is illustrated in line (b) of FIG. 3. Thereafter, the wall 112 is maintained at a potential of approx. +0.5 V. Once a stationary condition has built up at the time $t_2$, after the end of the quench pulse at the time $t_1$, the electrodes 121 and 122 are supplied with a potential such that the one electrode 121 assumes a potential of +2 V, while the other electrode 122 assumes a potential of −2 V, relative to the neighboring wall 111, as illustrated by the pulse-like potential variations 132 and 133 in lines (c) and (d) of FIG. 3. At the same time, the decelerating electrode 117 is supplied with a voltage of −0.5 V, as illustrated at 134 in line (e) of FIG. 3, whereafter the ion source is switched on so that it produces an ion flow which is indicated at 135 in line (f) of FIG. 3.

By applying a voltage to the electrodes 121, 122, a local electric field is generated which extends perpendicularly to the direction of the magnetic field B. This forces the ions which enter the ion trap between the electrodes 121, 122 to turn off radially in the direction of the lower electric potential. The effect of the electric field is limited in space and has a substantial influence of the cell potential only in the neighborhood of the entry opening 115. The ions leave this area in the direction of the cell axis 116 with an impulse component which is the result of their deflection and directed perpendicularly to the direction of the magnetic field, and at a correspondingly reduced velocity. They are then decelerated and deflected by the vertical wall 112 which exhibits the higher potential of 0.5 V, compared with the entry plate 111. The ions thus return into the area of influence of the potential prevailing between the electrodes 121, 122, though with a reduced axial impulse component which does no longer suffice to enable the ions to leave the ion trap 110; this is true the more as a second transversal deflection of the ions occurs at this point. Accordingly, a high proportion of the ions introduced by the ion flow 135 is trapped in the ion trap 110, and an accumulation of ions occurs as long as the ion flow is present, which leads to a very high ion density.

Figure 3:
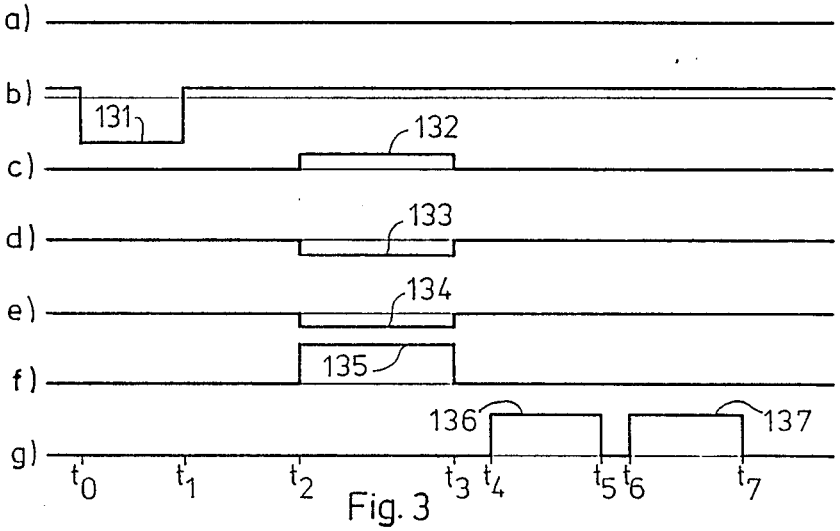
FIG. 3 shows a time diagram illustrating the different process steps to be carried out when operating the ion cyclotron resonance spectrometer according to FIG. 2.

Once the ion accumulation has ended at the time $t_3$, rf pulses 136, 137 can be irradiated into the ion trap in the usual manner, as indicated in line (g) of FIG. 3, in order to excite ion cyclotron resonance oscillations which can then be detected in the usual manner, after the end of the pulse 137 at the time $t_7$. The first rf pulse 136 may also serve to expel undesirable ion species from the ion trap.

It appears from the above description that the ion cyclotron resonance spectrometer according to the invention exhibits a conventional structure, except for the described modifications, and can be operated also with the usual operating parameters. The potentials which lead to the best results under the given circumstances can be determined easily in each case by experiments. The values given above have been stated only by way of example and can be readily optimized by corresponding experiments, depending on the particular design of the spectrometer, especially its ion trap, and on the ion species to be examined.

As regards the increase of the ion density that can be achieved with the aid of the method according to the invention, no generally valid figures can be given because it depends on several factors, including the intensity of the ion flow. The method according to the invention is particularly advantageous in cases where the ion flow has a low intensity and satisfactory ion density can be achieved only by accumulation. One practical application of the method according to the invention in mass spectrography with Fourier transformation (GC/FTMS operation), following a gas chromatograph, has shown that it was possible for example, due to the accumulation of the ions, to improve the detection sensitivity by approx. two orders of magnitude.

I claim:

1. Method for introducing ions into an ion trap of an ion cyclotron resonance spectrometer, the ion trap being arranged in a constant homogeneous magnetic field and comprising walls which are designed as electrodes and extend in parallel and/or perpendicularly to a symmetry axis having the direction of the magnetic field and which are supplied with electric trapping potentials retaining the ions in the ion trap, one of the walls which extend perpendicularly to the magnetic field being provided with a hole, the method including the steps of generating the ions outside the ion trap, forming the ions into an ion beam, directing the ion beam upon the hole in the one wall of the ion trap, in the direction of the magnetic field, and reducing thereafter the velocity component, in the direction of the magnetic field, of ions which have passed the hole and entered the trap, below the value determined by the trapping potentials which is needed by the ions for leaving the ion trap, characterized in that the ions that have entered the ion trap are imparted a second motion component in a direction perpendicular to the magnetic field, such that the magnitude of the ion velocity component in the direction of the magnetic field is reduced.

2. Method according to claim 1, characterized in that the ions are introduced into the ion trap along an axis set off laterally from the axis of symmetry of the ion trap extending in parallel to the magnetic field.

3. Method according to claim 1, characterized in that an electric field directed transversely to the direction of the magnetic field is generated in the ion trap during the time of application of the ion beam.

4. Method according to claim 3, characterized in that the electric field which is directed transversely to the direction of the magnetic field is generated in the localized region of the one wall of the ion trap which is provided with the hole.

5. Method according to claim 1, characterized in that the potential of the one wall of the ion trap, which is provided with the hole, is reduced below the trapping potential during application of the ion beam.

6. The method according to claim 1 further characterized in that the ions are accumulated for a period on the order of 500 milliseconds before impacting the walls of the trap.

7. Ion cyclotron resonance spectrometer comprising an ion trap which is arranged in a constant homogeneous magnetic field and comprises walls which are designed as electrodes and extend in parallel or perpendicularly to a symmetry axis having the direction of the magnetic field and having means for receiving electric trapping potentials retaining the ions in the ion trap, one of the walls extending perpendicularly to the magnetic field being provided with a hole, and comprising further means for introducing ions into the ion trap comprising an ion source, means for generating an ion beam which is emitted by the ion source in the direction of the magnetic field and directed upon the hole in the one wall of the ion trap, and means located in the localized region around the hole in said one wall for reducing the velocity component in the direction of the magnetic field of ions which have passed the hole and entered the ion trap, below the value determined by the trapping potentials which is needed by the ions for leaving the ion trap, characterized in that the means for reducing the velocity component of the ions in the direction of the magnetic field also impart to the ions that have entered the ion trap a second motion component perpendicular to the direction of the magnetic field, such that the magnitude of the ion velocity component in the direction of the magnetic field is reduced.

8. Ion cyclotron resonance spectrometer according to claim 7, characterized in that the hole arranged in the one wall of the ion trap is laterally offset relative to the axis of symmetry of the ion trap which extends parallel to the magnetic field (B).

9. Ion cyclotron resonance spectrometer according to claim 7, further comprising electrodes arranged on both sides of the hole and insulated from the one wall and having means for connecting the insulated electrodes to a voltage source that is switched on in a pulse-like manner.

10. Ion cyclotron resonance spectrometer according to claim 7, characterized in that the potential of a wall opposite one wall provided with the hole has the same sign as the charge of the ions to be trapped.

11. The apparatus of claim 7 wherein the means for reducing the ion velocity component in the direction of the magnetic field increases the accumulation time of the ions within the trap to a period on the order of 500 milliseconds.

* * * * *